US009629466B2

(12) United States Patent
Griggs, Jr.

(10) Patent No.: US 9,629,466 B2
(45) Date of Patent: Apr. 25, 2017

(54) READY TO ASSEMBLE FURNITURE INCLUDING A RECLINER PORTION

(71) Applicant: Billy Joe Griggs, Jr., Pulaski, TN (US)

(72) Inventor: Billy Joe Griggs, Jr., Pulaski, TN (US)

( * ) Notice: Subject to any disclaimer, the term of this patent is extended or adjusted under 35 U.S.C. 154(b) by 222 days.

(21) Appl. No.: 14/054,804

(22) Filed: Oct. 15, 2013

(65) Prior Publication Data

US 2014/0103695 A1 Apr. 17, 2014

Related U.S. Application Data

(60) Provisional application No. 61/713,289, filed on Oct. 12, 2012, provisional application No. 61/758,242, filed on Jan. 29, 2013, provisional application No. 61/758,263, filed on Jan. 29, 2013, provisional application No. 61/802,963, filed on Mar. 18, 2013.

(51) Int. Cl.
*A47C 4/02* (2006.01)
*A47C 1/02* (2006.01)

(52) U.S. Cl.
CPC . *A47C 4/02* (2013.01); *A47C 1/02* (2013.01)

(58) Field of Classification Search
CPC ..... A47C 4/02; A47C 1/02
USPC ..... 297/440.1, 85 R
See application file for complete search history.

(56) References Cited

U.S. PATENT DOCUMENTS

| | | | | |
|---|---|---|---|---|
| 4,394,048 | A | 7/1983 | Sakurai et al. | |
| 5,288,126 | A * | 2/1994 | Saul | A47C 1/0355 297/85 R X |
| 5,419,611 | A | 5/1995 | Cook | |
| 5,704,686 | A * | 1/1998 | May | A47C 1/0355 297/85 R X |
| 5,806,921 | A * | 9/1998 | LaPointe | A47C 1/0345 297/440.1 |
| 7,147,278 | B2 * | 12/2006 | Johnson | A47C 1/0352 297/85 R |
| 7,328,949 | B2 | 2/2008 | Donovan et al. | |
| 7,497,512 | B2 * | 3/2009 | White | A47C 1/0355 297/85 R |
| 7,673,933 | B2 | 3/2010 | Lawson | |
| 2010/0072805 | A1 * | 3/2010 | Qiu | A47C 1/0355 297/85 R X |

FOREIGN PATENT DOCUMENTS

EP 0619967 A1 10/1994

* cited by examiner

*Primary Examiner* — Anthony D Barfield
(74) *Attorney, Agent, or Firm* — Wayne Edward Ramage; Baker Donelson; David Barman

(57) ABSTRACT

An RTA furniture with a recliner is provided whereby the recliner mechanism is provided attached to the RTA component parts and provides a disassembled configuration that is substantially rectangular.

10 Claims, 20 Drawing Sheets

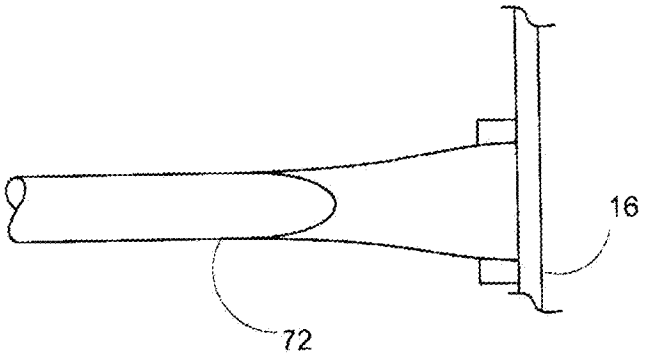
FIG.19B
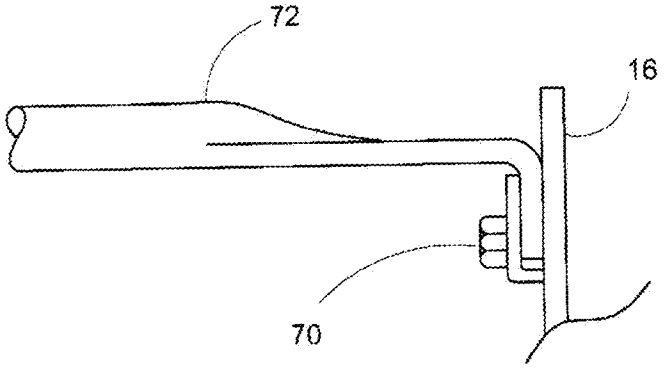
FIG.19A
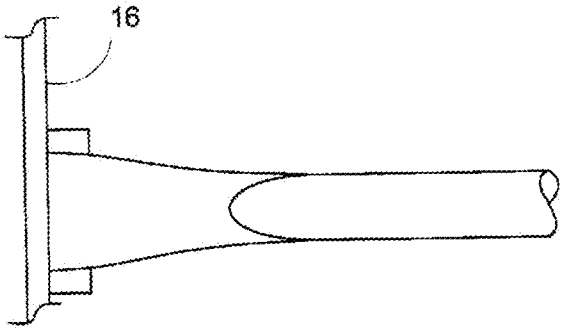
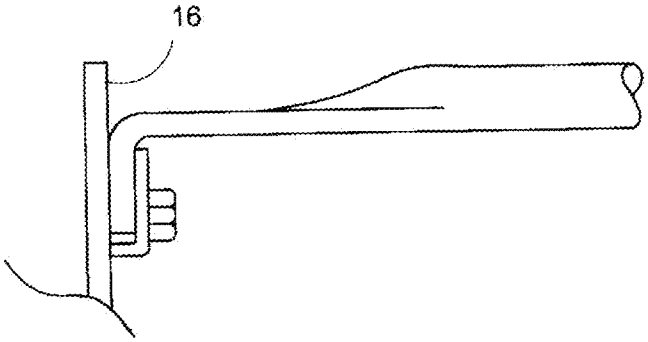

READY TO ASSEMBLE FURNITURE INCLUDING A RECLINER PORTION

INDEX TO RELATED APPLICATIONS

This application claims benefit to each of U.S. Provisional Patent Application No. 61/713,289 filed Oct. 12, 2012; U.S. Provisional Patent Application No. 61/758,242 filed Jan. 29, 2013; U.S. Provisional Patent Application No. 61/758,263 filed Jan. 29, 2013; and U.S. Provisional Patent Application No. 61/802,963 filed Mar. 18, 2013, the disclosures of which are incorporated herein by reference in their entirety.

BACKGROUND OF THE INVENTION

Ready to assemble furniture is very popular because it can be relatively inexpensive as compared to fully assembled furniture, and for ease of assembly. However, there are pieces of furniture that have been proven to be exceedingly difficult to provide as ready to assemble furniture. One such type of furniture relates to any type of furniture in which a recliner mechanism is included.

Recliner mechanisms create particular problems when provided with ready to assemble furniture; in fact, the precision of preparing the interlocking parts is typically beyond the ability of the average person working with ready to assemble furniture. The present invention addresses this deficiency and provides a novel RTA assembly whereby recliner components are provided.

SUMMARY OF THE INVENTION

The present invention provides an RTA recliner that assembles in a manner significantly less complex then current recliners.

The RTA recliner mechanism of the present invention is also easy for assembly in a manufacturing environment due to the fact that the novel configuration as an RTA article speeds up the assembly process. In an environment where a manufacturer of distributor desires to assemble the RTA recliner prior to shipment, it provides a more rapid assembly time then currently assembled recliners.

Persons familiar with the furniture industry in the U.S. recognize it is difficult to manufacture reclining furniture outside states like MS and NC, because it is hard to find skilled labor to do this. With the recliner of the present invention, including the inventive slide and lock concept mechanism mounting configuration, assembly is easier for manufacturers and gives manufacturers greater latitude to recruit and hire persons capable of assembly.

Although the general description herein is illustrated as a recliner, the present invention is suitable for may types of furniture, including, but not limited to gliding recliners, rockers, swivel recliners, swivel chairs, sofas, loveseats, chairs, sectionals, modular pieces, and the like.

In one embodiment, the present invention is a ready to assemble (RTA) recliner comprising:

a first configuration, being a disassembled configuration, said first configuration having an assembled functioning recliner mechanism, wherein said mechanism is constructed and arranged to be packaged with component parts; and a second configuration, whereby said second configuration is an assembled configuration, said assembled configuration completed in an assembly process in which hand tools, including, but not limited to, wrenches, pliers, vices, hammers, screwdrivers and the like are not required, said second configuration utilizing said reclining mechanism, wherein said reclining mechanism is constructed with a male-female sliding track for providing movement, said female track fixed to said RTA recliner, and complementary male portion sliding within said female track to provide motion and actuate said recliner mechanism into reclined and retracted positions.

In one embodiment the invention includes

A connection apparatus for furniture, comprising:

- a pair of scissor mechanisms, one left facing and one right facing, each with a top, bottom, front and back; and
- a first connector attached to the bottom of each of said scissor mechanisms, said first connector adapted to receive and snap-lock a corresponding second connector mounted on a furniture base.

The furniture base comprises one of: a rocker base, a swivel base, a glider base, a glider-swivel base, a stationary base, or combinations thereof.

In one embodiment the invention is a connection apparatus for furniture, comprising:

- a pair of scissor mechanisms, one left facing and one right facing, each with a top, bottom, front and back; and
- one or more seat connectors attached to the top of each of said scissor mechanisms, said one or more seat connectors adapted to receive and snap-lock one or more corresponding seat box connectors mounted on a furniture seat box.

The connection apparatus further comprises one or more arms connected to said furniture seat box by a plurality of male-female connectors.

In one embodiment, the invention is a connection apparatus for furniture, comprising:

- a pair of scissor mechanisms, one left facing and one right facing, each with a top, bottom, front and back; and
- a footrest connection bracket attached to the front of each scissor mechanism, said footrest connection bracket adapted to attach to a corresponding bracket on a footrest.

The connection apparatus has each scissor mechanism further comprises a seat back connection bracket attached to the back of each scissors mechanism, said seat back connection bracket adapted to attach to a corresponding bracket on a furniture seat back.

In one embodiment, the invention is a connection apparatus for furniture, comprising:

- a pair of scissor mechanisms, one left facing and one right facing; and
- a drive bar or tube with a right end and a left end extending between the pair of scissor mechanisms and snap-lock connected thereto.

The ends of the drive bar or tube are connected to the corresponding scissor mechanism with a spring-socket ball structure. Also, the ends of the drive bar or tube are connected to the corresponding scissor mechanism with male/female clips.

The connection further comprises a foot rest release handle snap-lock mechanically linked to one end of said drive bar or tube.

In one embodiment, the invention is a connection apparatus for furniture, comprising:

- a pair of scissor mechanisms, one left facing and one right facing, each with a top, bottom, front and back; and
- a stabilizer or support bar or tube with a right end and a left end extending between the pair of scissor mechanisms and connected by clips thereto.

BRIEF DESCRIPTION OF THE SEVERAL VIEWS OF THE DRAWING

FIG. 19A is a partial front view demonstrating base support positioned between two scissor assemblies.

FIG. 19B is a partial top view demonstrating a support between two scissor assemblies.

DETAILED DESCRIPTION OF THE PREFERRED EMBODIMENT

Figure 1:
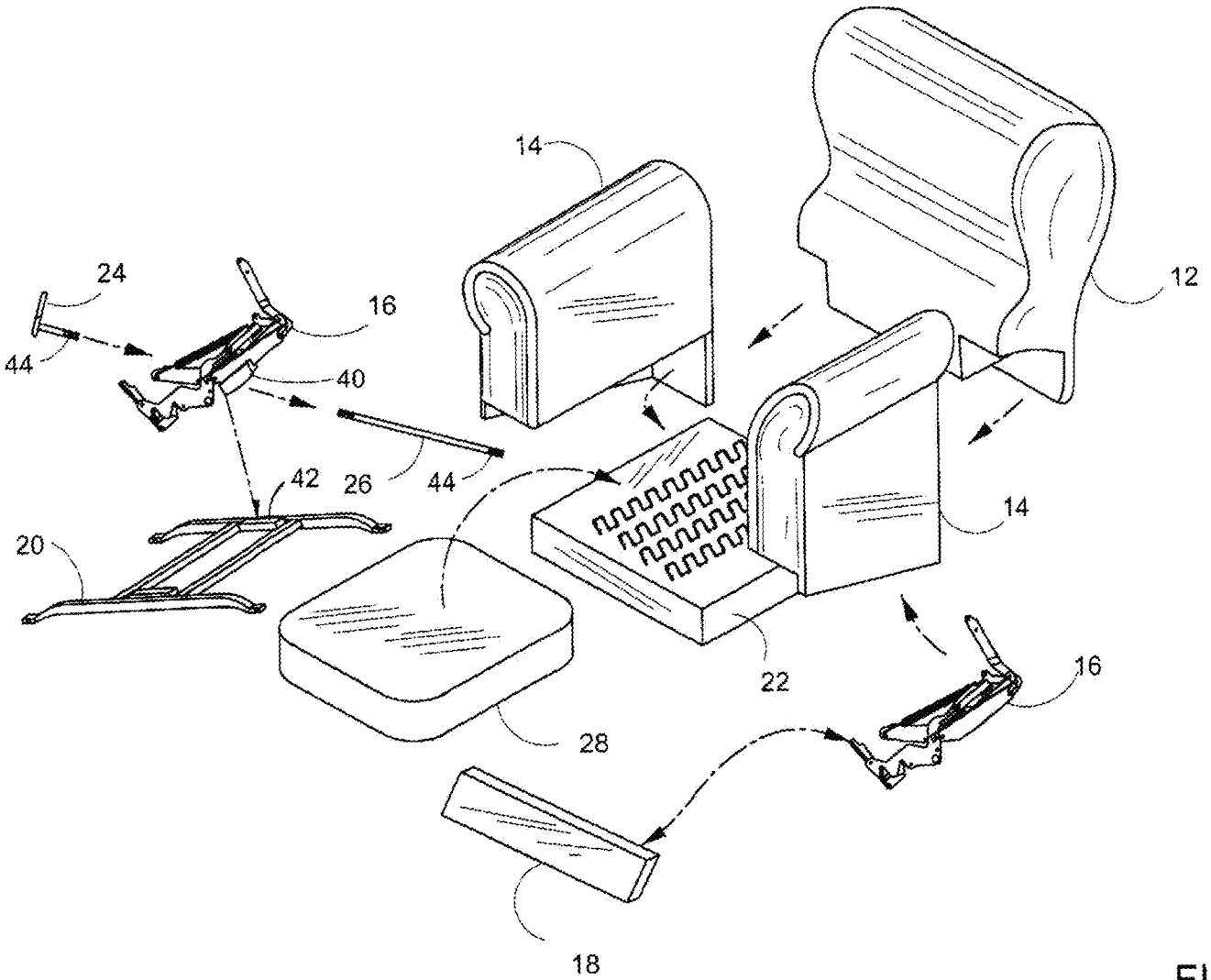
FIG. 1 is an exploded view of one embodiment of components of the present invention.
Figure 2A:
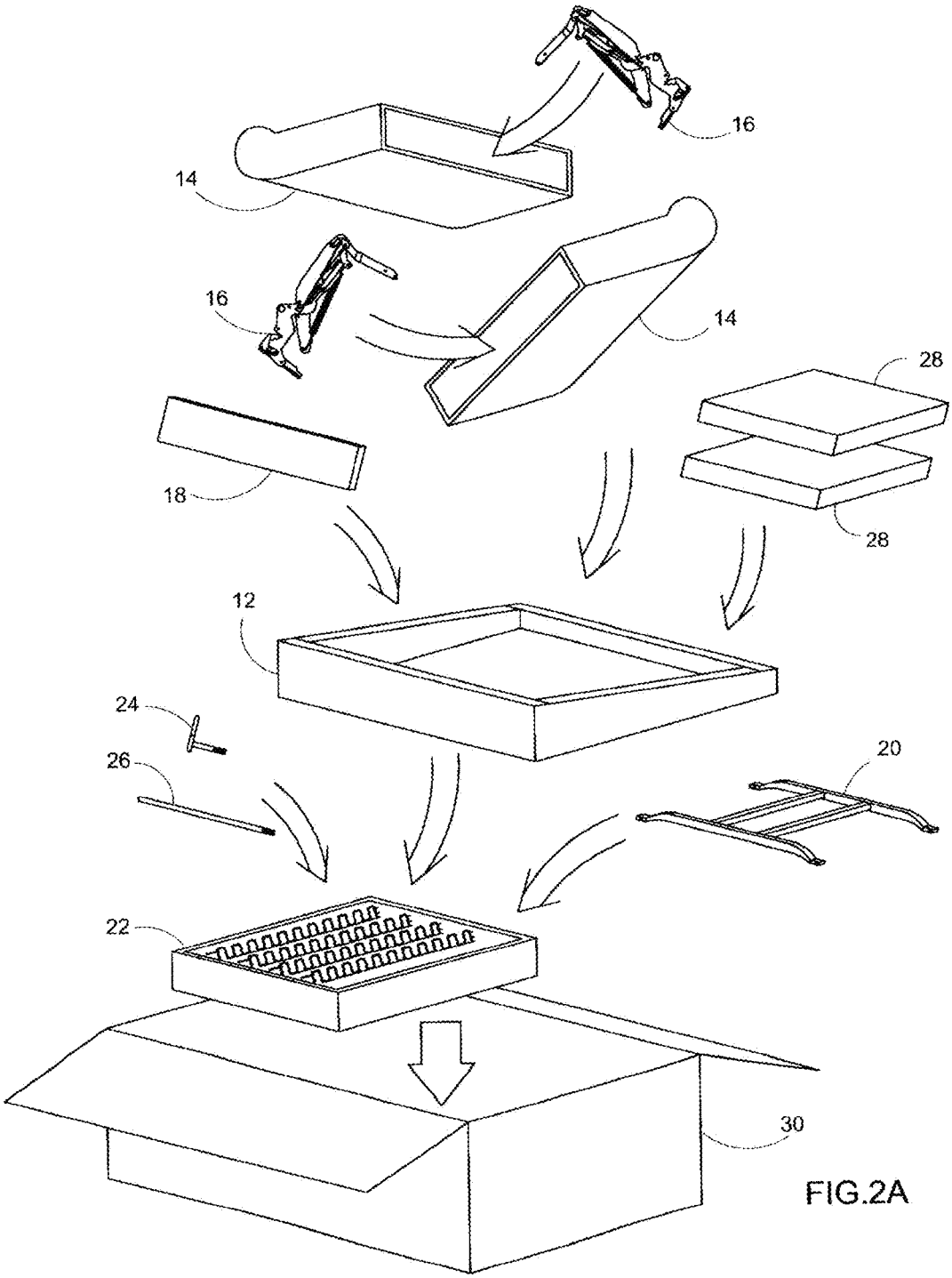
FIG. 2A is a separate view of one embodiment of the present invention showing arrangement of the components of the present invention in a packing container.
Figure 2B:
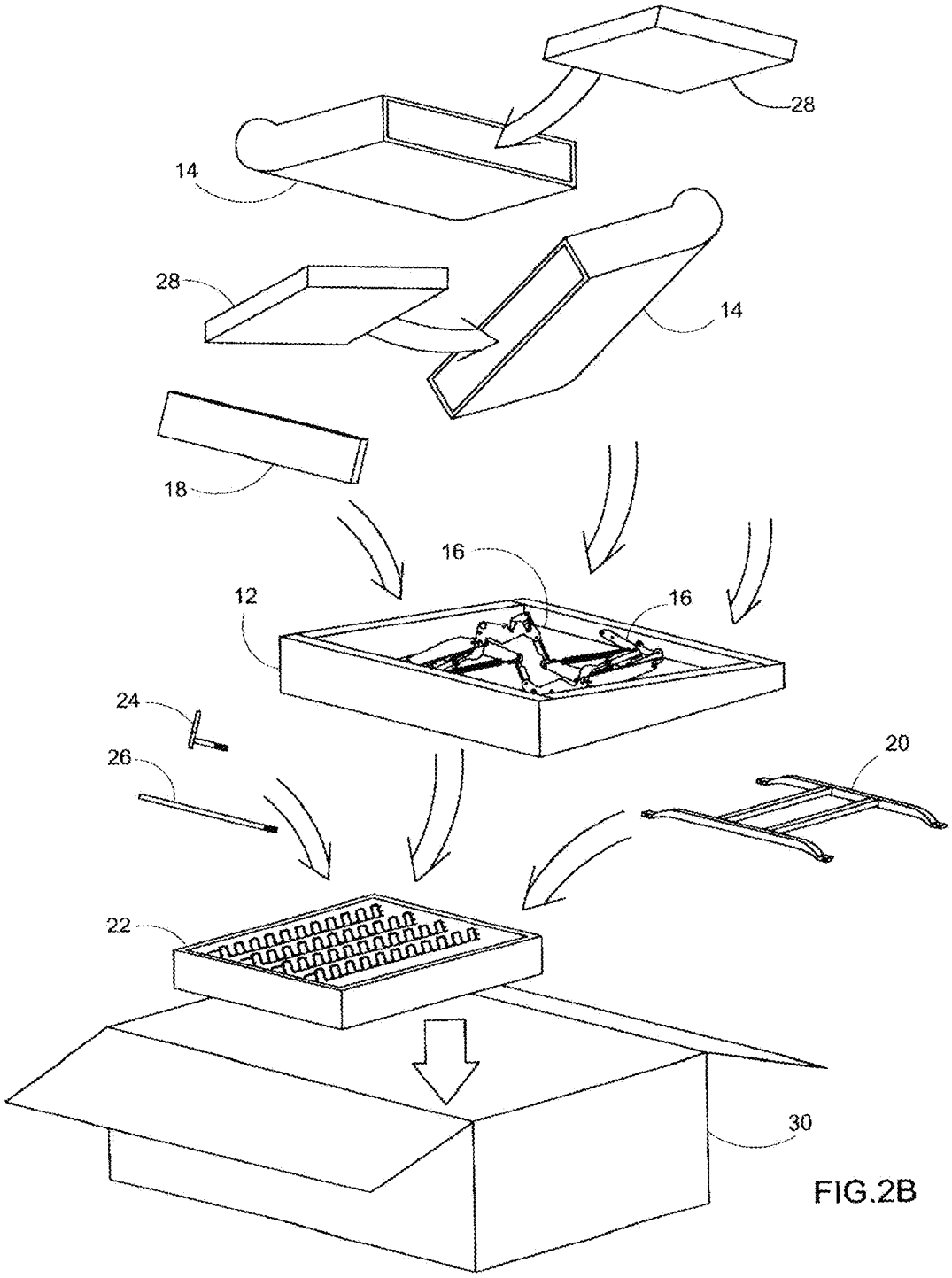
FIG. 2B is a separate view of another embodiment of the present invention showing arrangement of the components of the present invention and a packing container.

Ready to assemble furniture is popular with consumers. Reclining furniture is often bulky and cannot be provided as a ready to assemble (RTA) product.

The present invention has developed an article of furniture incorporating at least one recliner, whereby the configuration has a first configuration being a disassembled configuration and a second configuration being an assembled configuration.

Although the term "recliner" is used herein, the recliner is intended to be used as a stand alone recliner, or a recliner incorporated into a sofa, love seat, sectional, and any other larger piece of furniture (larger relative to a stand alone recliner).

The disassembled configuration, in a preferred embodiment, provides for a RTA recliner having a functional and assembled recliner mechanism secured to a seat base, but the recliner mechanism and other components are constructed and arranged to fit in a rectangular shaped container utilizing 80-99% of the interior volume of said container. The volume utilization in a rectangular container is important in maximizing volume and reducing shipping costs.

Conventional recliners are provided in one of two ways: completely disassembled and requiring significant amount of skill and tools to assemble the recliner mechanism; or completely assembled and having back portions with angular offsets relative to the seat to provide a seat back that is an obtuse angle in the sitting area. This offset results in inefficient utilization of shipping volume.

The present invention has utilized several unique recliner mechanism configurations and incorporated these into the present invention.

One mechanism provides the recliner on a track with a male-female interaction. The male portion being movable within the track and having locking points constructed to restrict movement at predetermined intervals.

Other embodiments contemplate similar configurations as the track mechanism. It is contemplated that configurations in which the recliner mechanism imparts a linear or substantially linear configuration when the mechanism is activated. The novel linear relationship of the movable portion in relation to the fixed portion provides the geometric configuration that allows the recliner to be packaged in an unassembled configuration in a rectangular box with the other furniture components. In one embodiment, the mechanism is moved with a slide and lock arrangement. In yet another embodiment, the mechanism interaction is through a snap and lock system.

The present invention provides an assembly whereby the elimination of many bolts and connectors is achieved by using a slide and lock or snap assembly system.

The present invention represents a significant cost savings in manufacture and production because this system is eliminating 20+ bolts depending on style of mechanism. A manufacturer will be able to assemble approximately 4 times as many mechanisms with half of the labor.

This also saves on repairs because the consumer can replace a part by just snapping it on and off.

The invention is contemplated to be used with all motion/reclining mechanisms, including, but not limited to recliner, sofa, loveseat, sectional, loungers, modular pieces.

A non-limiting list of some of the connections includes:

1. male bracket on scissors connects to female bracket on seat box frame,
2. male bracket on scissors connects to female bracket on footrest,
3. drive tube connects to left facing scissor and right facing scissor with the spring button or push button,
4. reclining sofa mechanism has the stabilizer/support tube that connect to the left facing scissors and right facing scissors with the male and female clips,
5. arms fasten on with male female connector (hand knob bolts), 6. release handle assembly connects with the push button or spring button, 7. the base assembly which could be a rocker base, swivel base, glider base, glider swivel base combination or a stationary base will connect male female—slide lock, snap connection, 8. position a base rail on the piece to make it a one piece sofa; alternatively, it can be done as a modular piece, allowing the customer to build their own sofa or sectional because in is individual pieces 9. the back will snap on with male female connectors.

In one embodiment, the RTA recliner additionally minimizes the use of tools by connecting pieces with complimentary peg and slot connectors.

A fixed peg inserts into a complimentary slot and moves along the slot into a position that locks and/or restricts movement of the peg.

The RTA recliner of the present invention assembles without use of any tools, especially hand tools. There is no need for screwdrivers, hammers, pliers, vice grips, wrenches or any type of tools. The RTA recliner of the present invention is strong and sturdy, even when assembled without tools.

In one embodiment, as demonstrated in FIG. 1, assembly 10 is formed with a base frame 20. Said base frame 20 constructed and arranged with a cam receiver 42 that receives a rocker cam 40 whereby said rocker cam 40 is attached to the bottom portion of rocker scissor mechanism 16. A pair of rocker scissor mechanisms 16 are provided, each positioned into a cam receiver 42 in frame 20. Once each cam is positioned, a cross rod 26 is connected to each of scissor mechanisms 16. In one embodiment, cross rod 26 connects into scissor mechanism 16 by virtue of a spring-socket ball connect mechanism 44. As is known in the art, the spring socket ball connect mechanism 44 has a ball like structure protruding outward from cross rod 26 whereby the structure is urged outward by a spring. When cross rod 26 is inserted into a receiver formed on scissor mechanism 16, the ball structure is pushed inward until mating with a locking orifice. These locking mechanisms are sometimes referred to as ball detent clevis pins or ball lock pins.

Figure 4A:
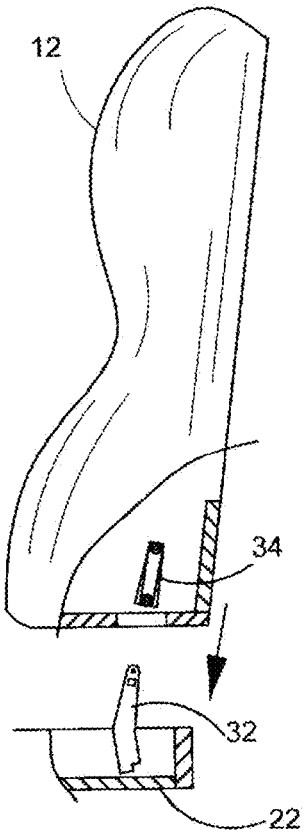
FIG. 4A is a side partial cross-section view demonstrating attachment of a seat back to a furniture base.
Figure 4B:
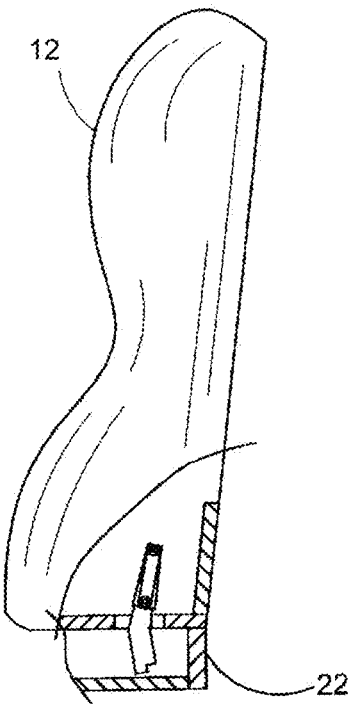
FIG. 4B is a side partial cross-sectional view demonstrating the completion of attachment of a seat back to a furniture base from FIG. 4A.
Figure 3:
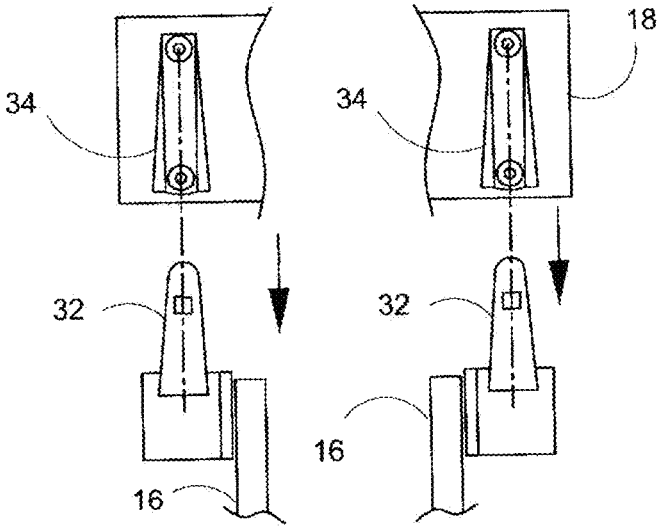
FIG. 3 is a view demonstrating assembly of a recliner footrest to a recliner scissor assembly.
Figure 5:
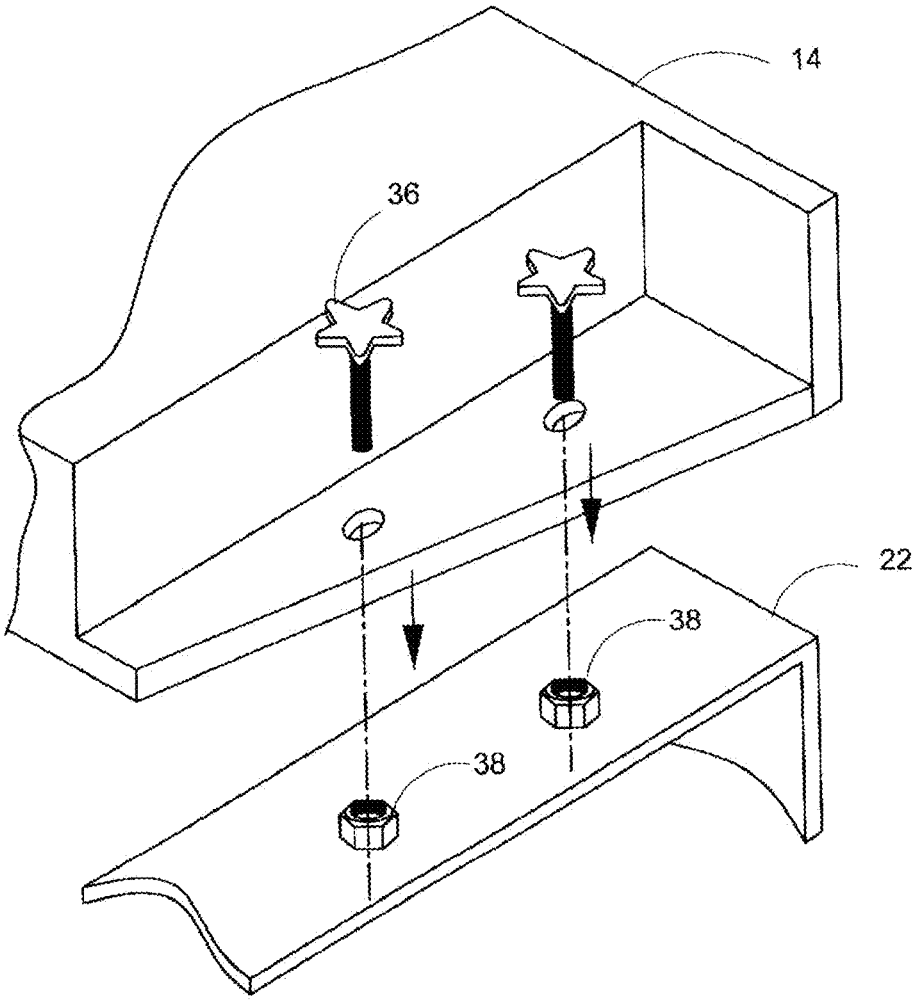
FIG. 5 is a partial perspective view demonstrating attachment of arms to a furniture base.

As demonstrated in FIG. 3, each scissor mechanism 16 has incorporated thereon a connector 32 constructed and arranged to meet with a complementary connector 34 that is positioned on foot rest 18. This connector system as demonstrated in FIGS. 4A and 4B whereby complementary connectors are used to attach seat back 12 two furniture seat base 22.

Additionally contemplated in the present invention are connectors for at least one arm portion 14 utilizing hand bolt 36 that attaches to seat base 22 by connector nuts 38 incorporated onto seat base 22.

Figure 6:
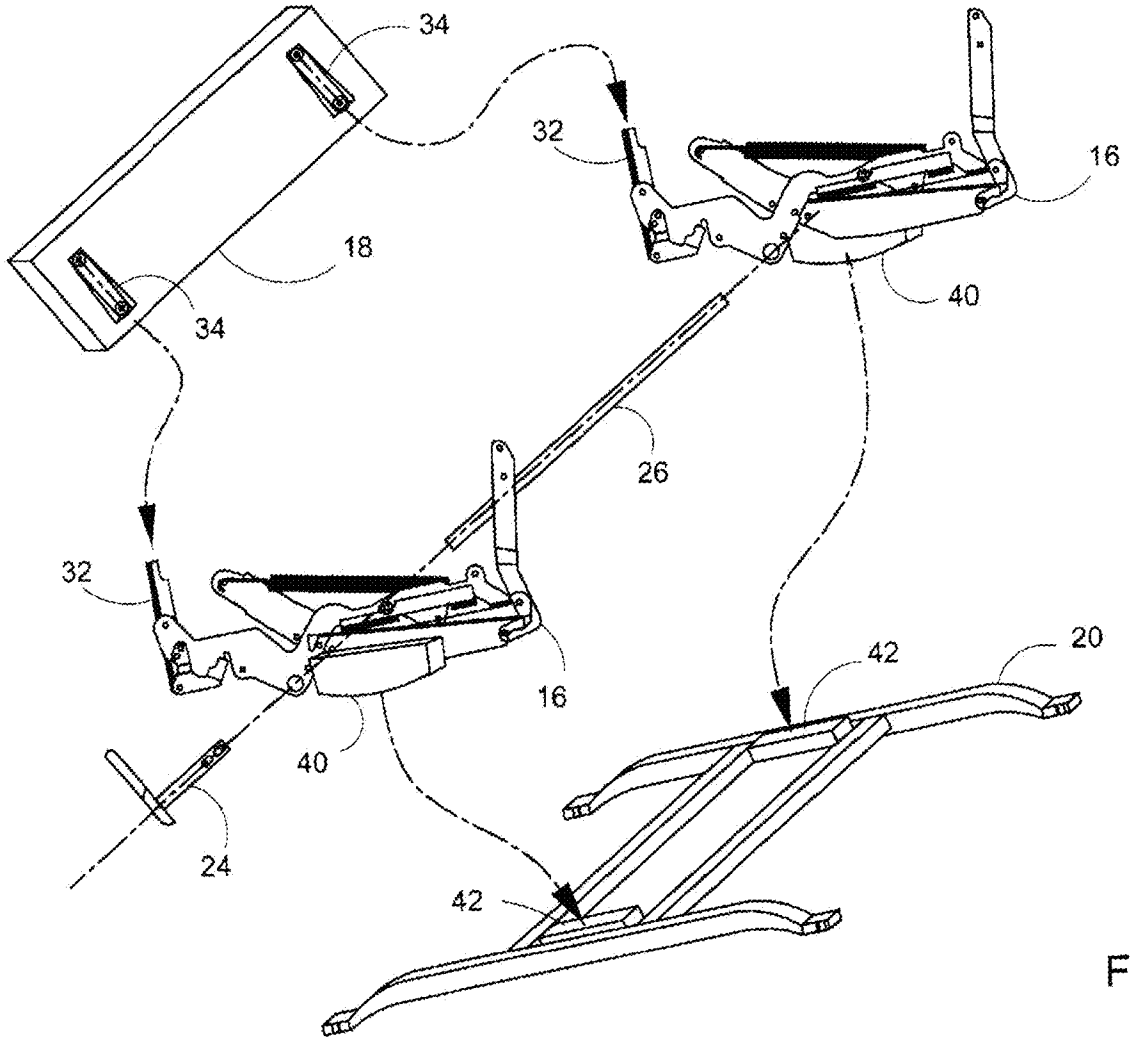
FIG. 6 is a separate view demonstrating arrangement of a pair of recliner scissor assemblies and a foot rest connected onto a furniture base.
Figure 8:
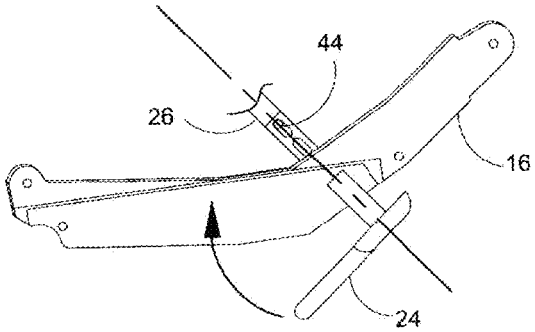
FIG. 8 is a partial perspective view of an assembled foot rest and scissors according to the present invention.
Figure 7:
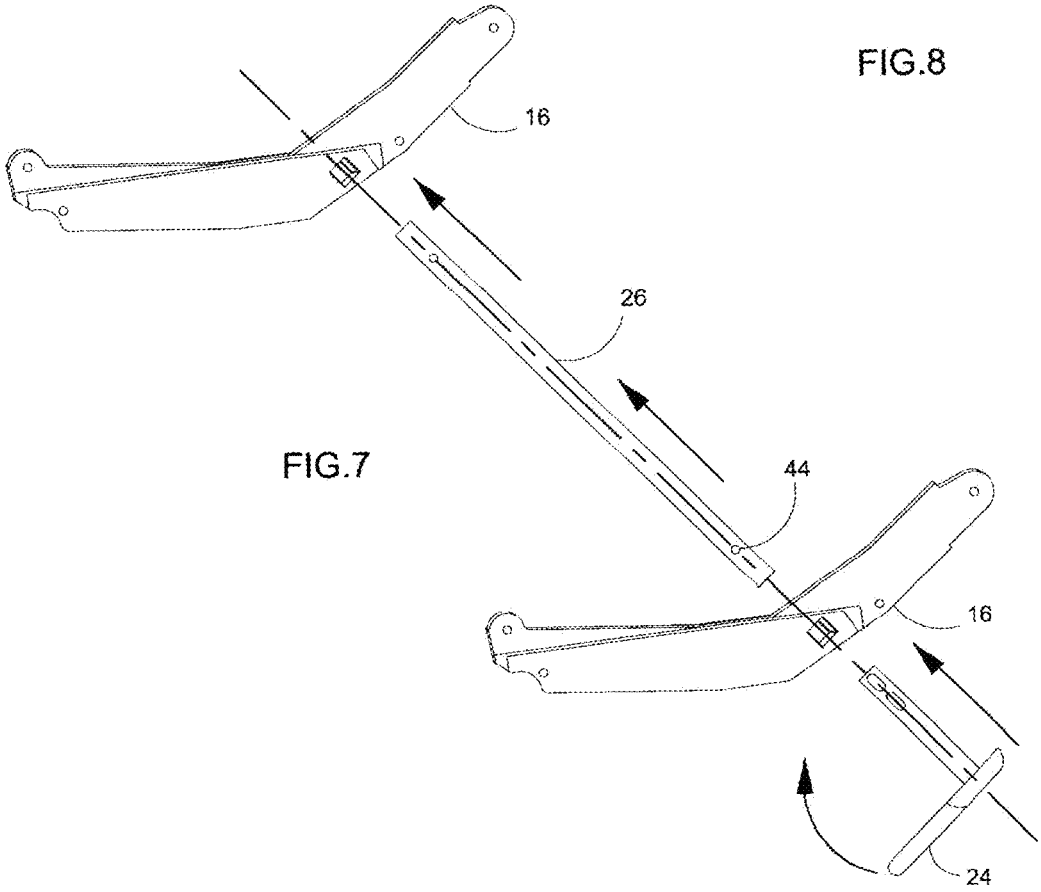
FIG. 7 is a perspective view of a disassembled foot rest and scissors assembly with directional arrows indicating the direction of attachment.
Figure 9:
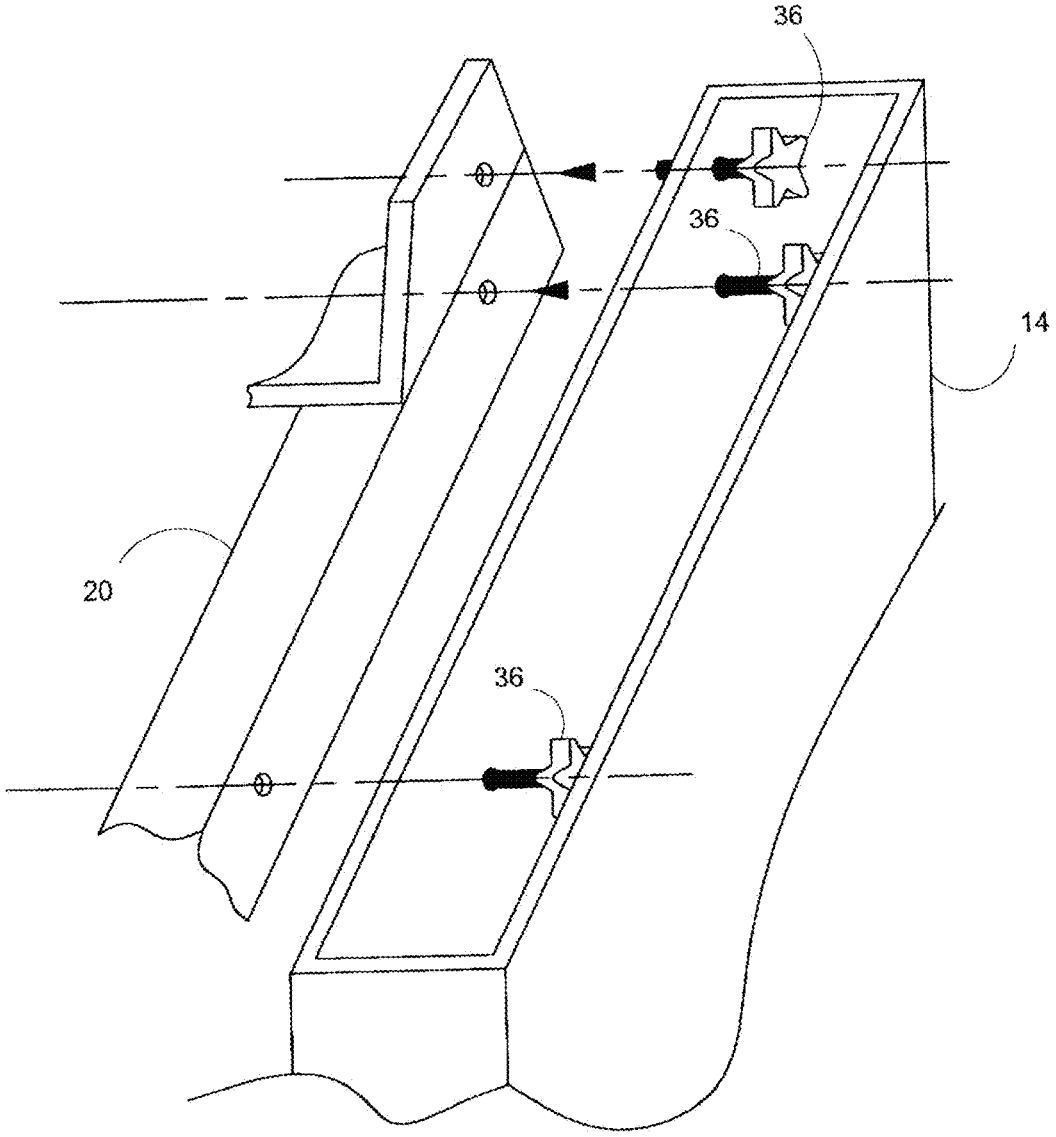
FIG. 9 is a partial perspective view showing attachment of an arm to a furniture frame.

As shown in FIG. 6, the directional arrows indicate placement of each of the scissor mechanisms 16 onto base frame 20 whereby scissor mechanisms 16 are stabilized with at least one cross rod 26 as described. In one embodiment, a foot rest handle 24 is connected to at least one of scissor mechanisms 16.

Figure 10:
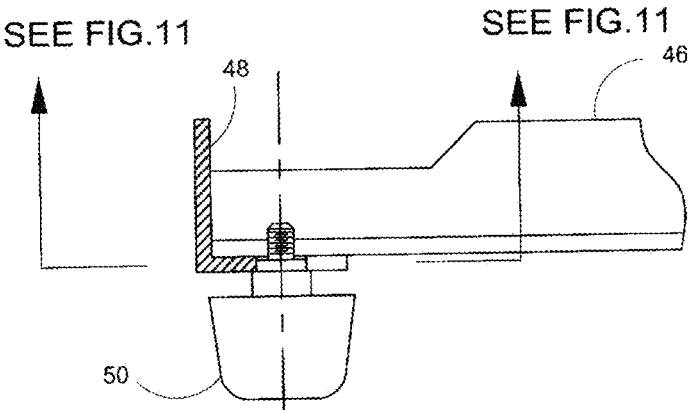
FIG. 10 is a partial cross-section view showing a keyhole attachment system according to the present invention.
Figure 11:
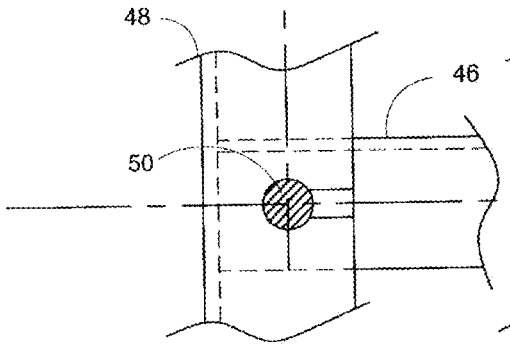
FIG. 11 is a section view along the section lines from FIG. 10 showing the keyhole attachment system.
Figure 12:
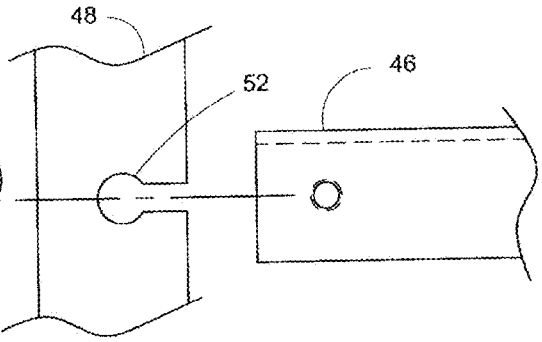
FIG. 12 is an exploded view of the attachment system of FIG. 11.
Figure 13:
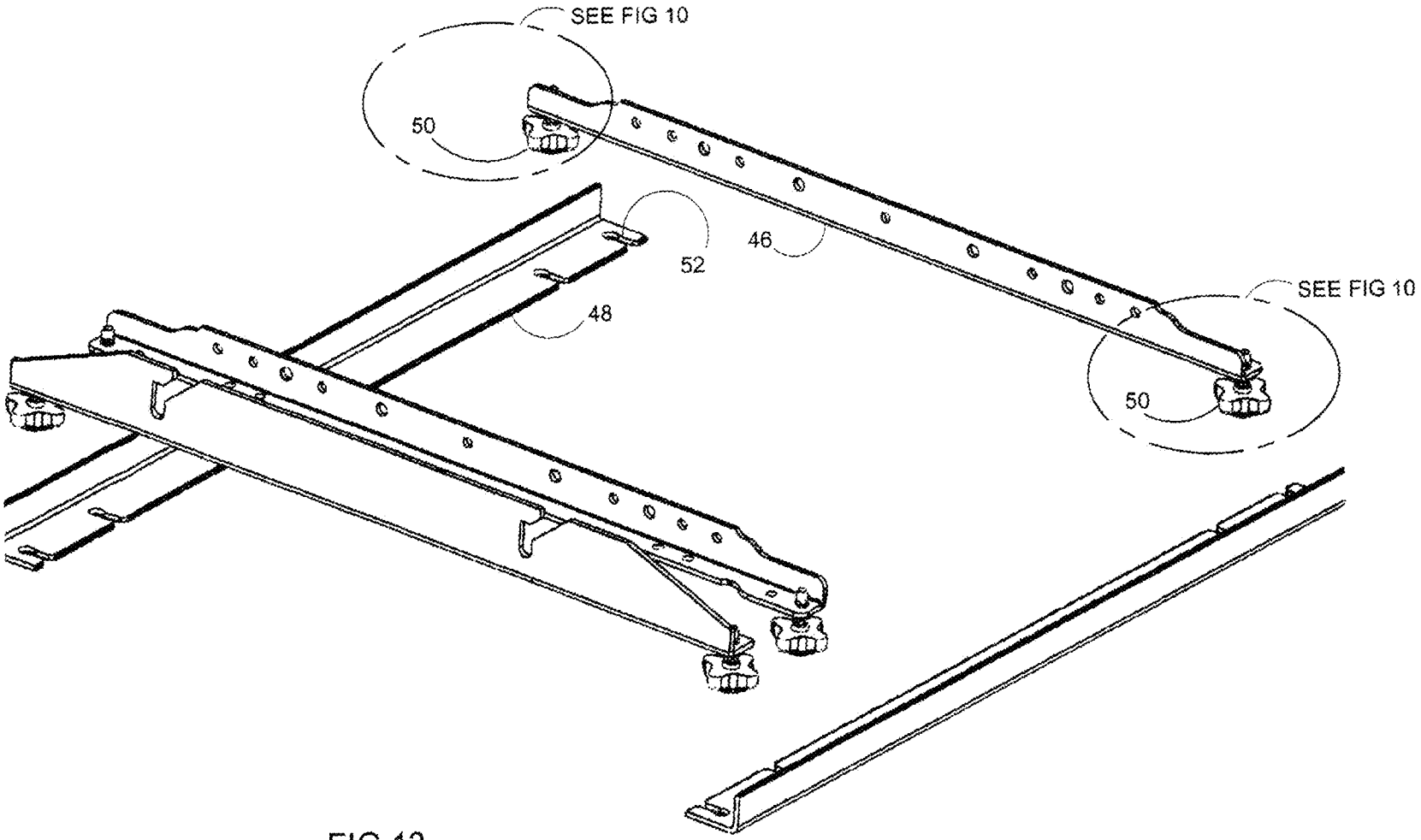
FIG. 13 is a frame fastening system demonstrating a keyhole slot attachment for the assembly.
Figure 14:
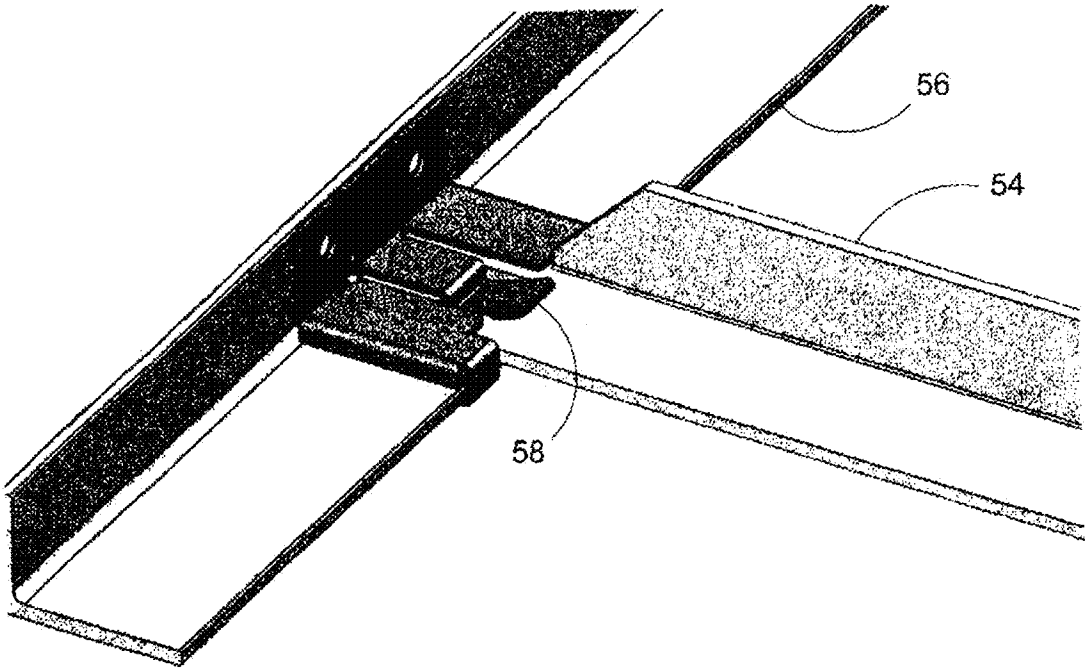
FIG. 14 is a partial perspective view demonstrating a keyhole slot frame assembly.

In one embodiment, as demonstrated in FIGS. 10 through 12, a fastener which serves a dual purpose as a foot for the article of furniture is positioned into frame member 48 and frame member 48 has incorporated there in a keyhole slot 52 that interconnects for assembly of the frame. Keyhole slot 52 will interact with the screw fastener 50 to form the furniture frame as demonstrated in FIGS. 10 through 13.

Figure 15:
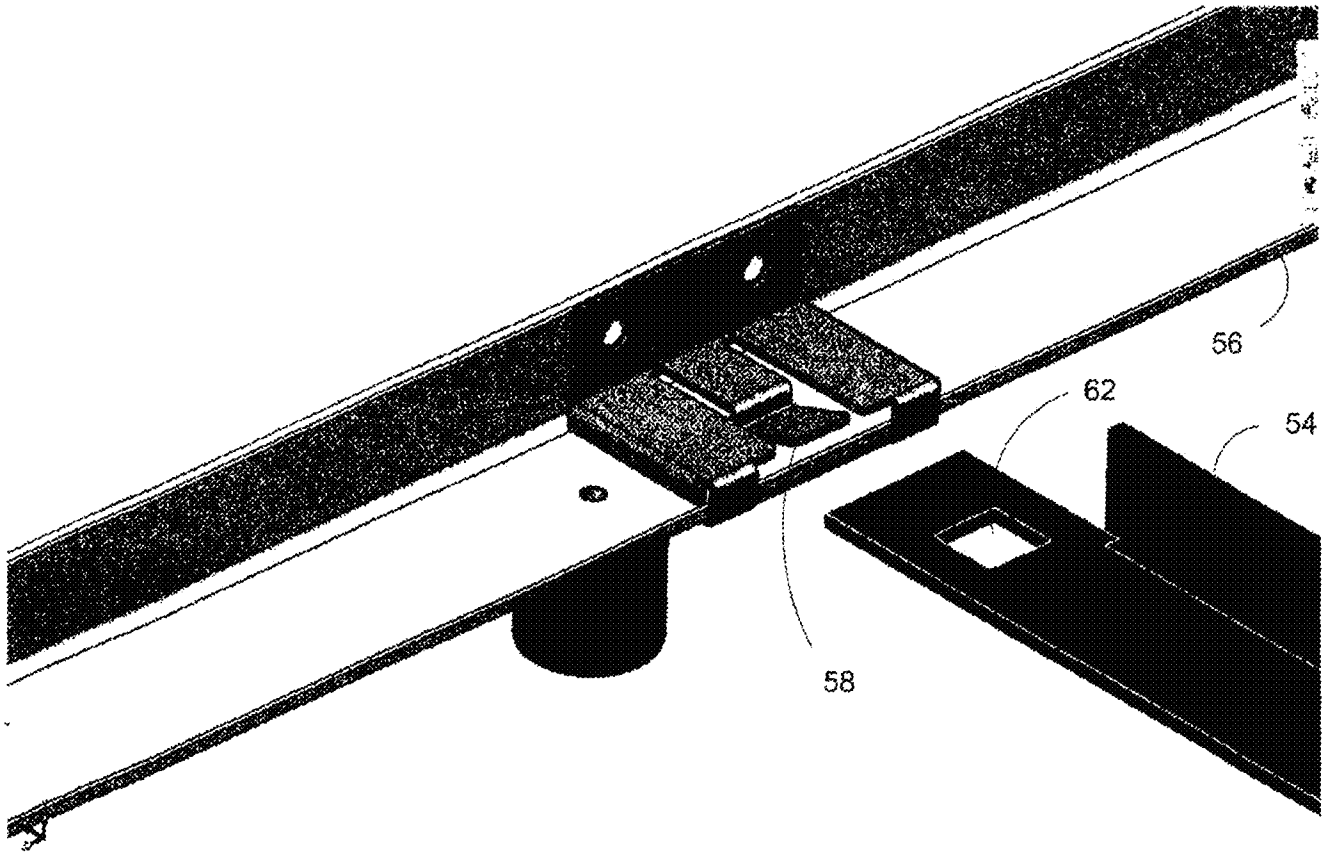
FIG. 15 is a partial perspective view of a spring clip attachment mechanism according to one embodiment of the present invention.
Figure 16:
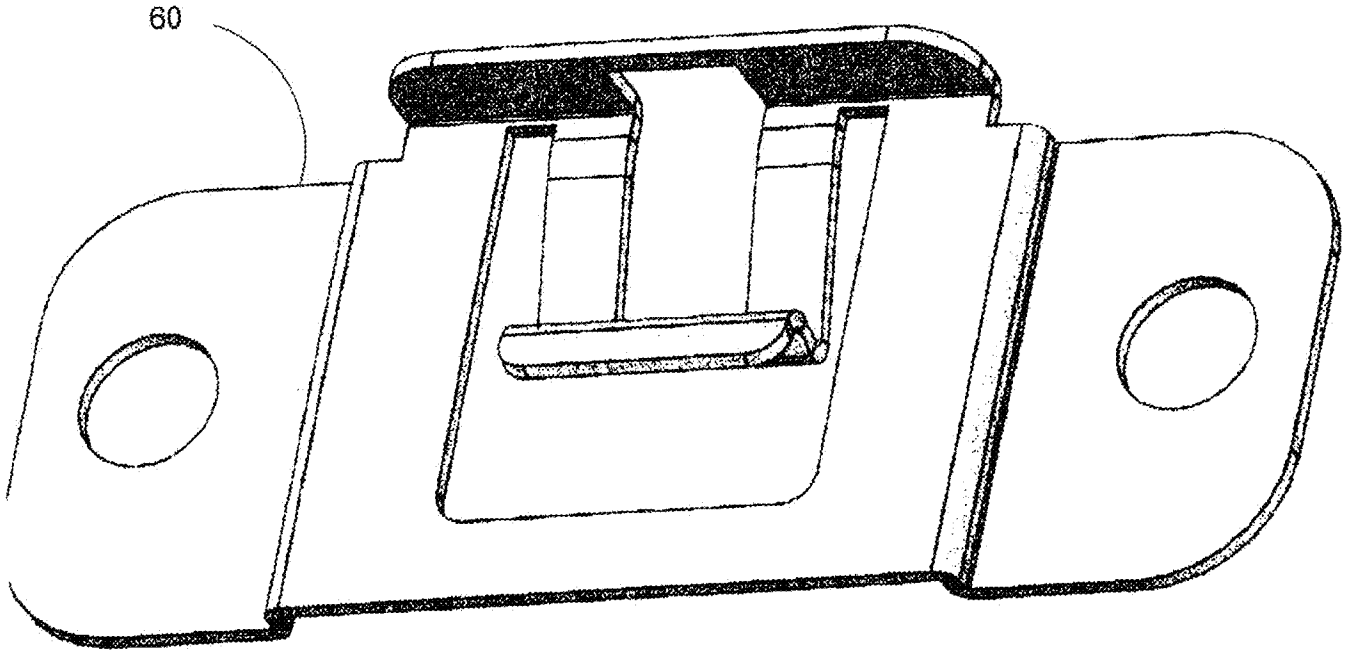
FIG. 16 is a perspective view of a frame fastener spring clip of the present invention.

In one embodiment, spring clip 58 is constructed and arranged to assemble brace 54 with frame angle member 56. As demonstrated in FIG. 15, spring clip 58 is an "L" mount clip that interacts with spring clip locking recess 62 incorporated onto brace 54 and configured to attach brace 54 two angle members 56 in a furniture frame of the present invention. In one embodiment, as shown in FIG. 16, flat mount spring clip 60 is utilized in connecting components of the furniture frame.

Figure 17:
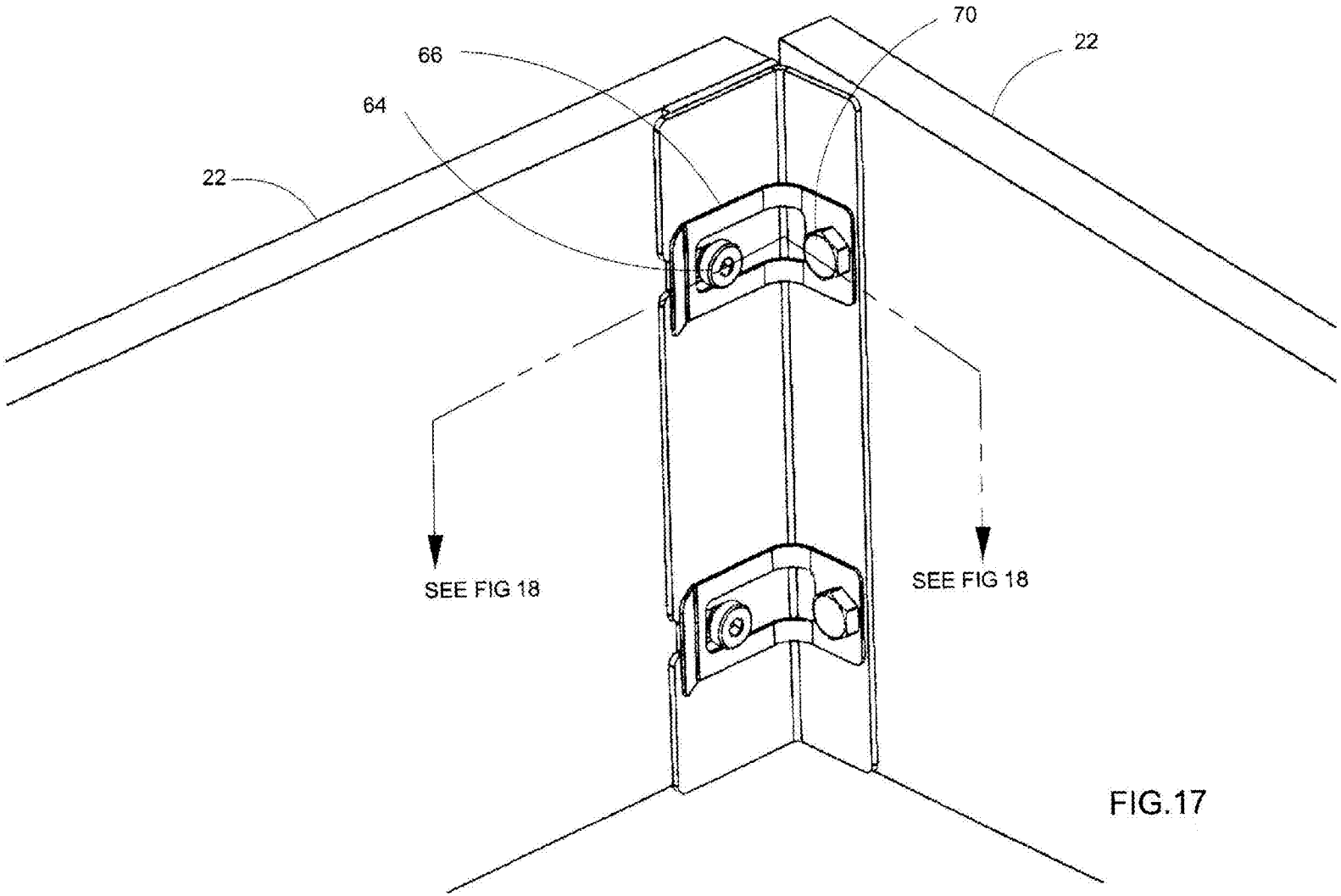
FIG. 17 is a perspective view of a frame fastening system utilizing an "L" clip.
Figure 18:
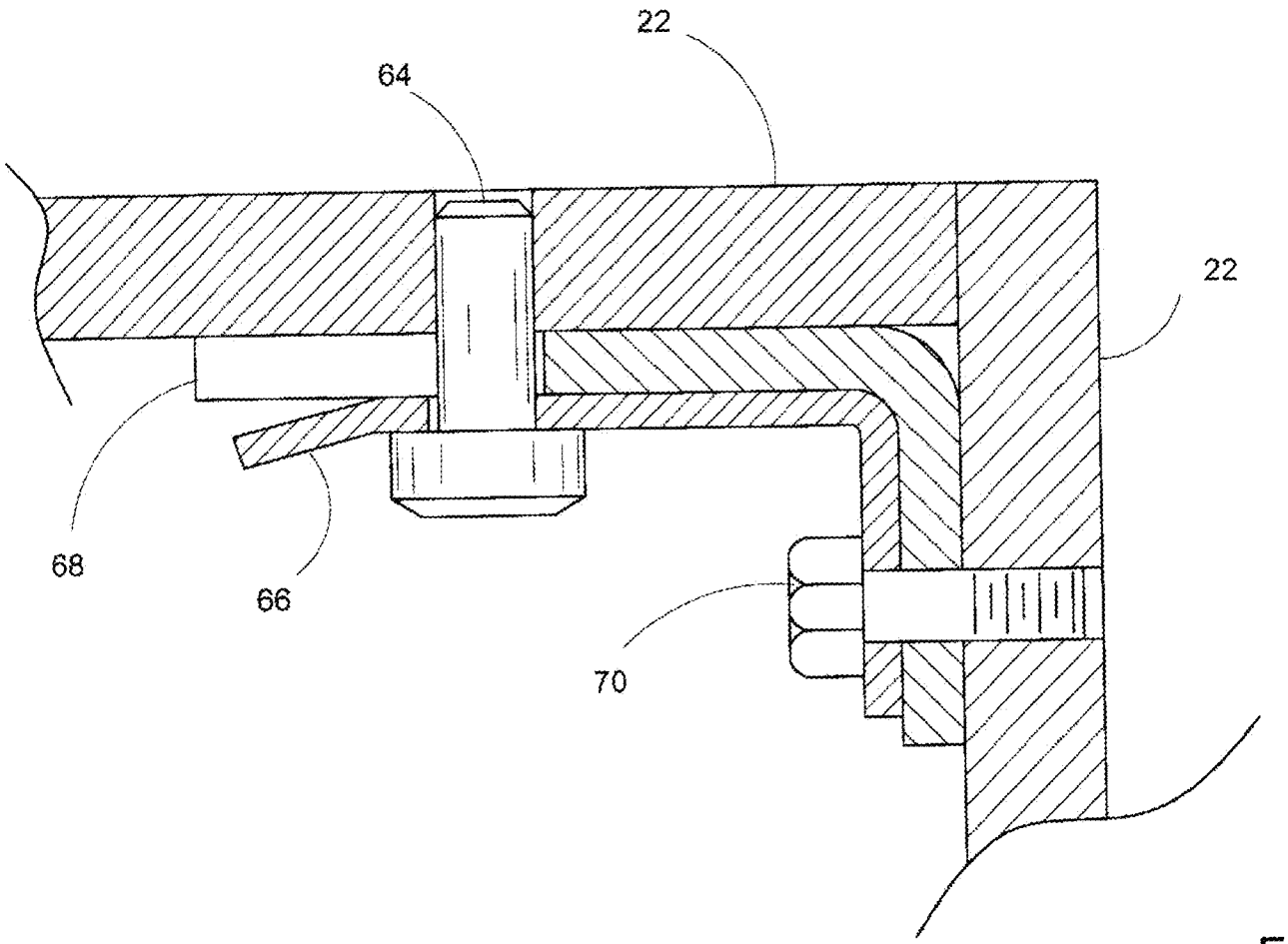
FIG. 18 is a cross-section view demonstrating assembly utilizing a "C" clip.

In one embodiment, shown in FIG. 17, a "c" spring clip 66 is used for connecting two portions of seat base 22 whereby mounting bolt 70 and locking rivet 64 are used to effectuate the connection. FIG. 18 demonstrates a cross-section utilizing "c" spring clip 66 to connect each of seat base portions 22.

As demonstrated in FIGS. 19A and 19B, a scissor support tube 72 connects each of scissor portions 16 utilizing a connecting and mounting system as described herein. As shown in these figures, mounting bolt used with "c" spring clip 66 is demonstrated.

Figure 20:
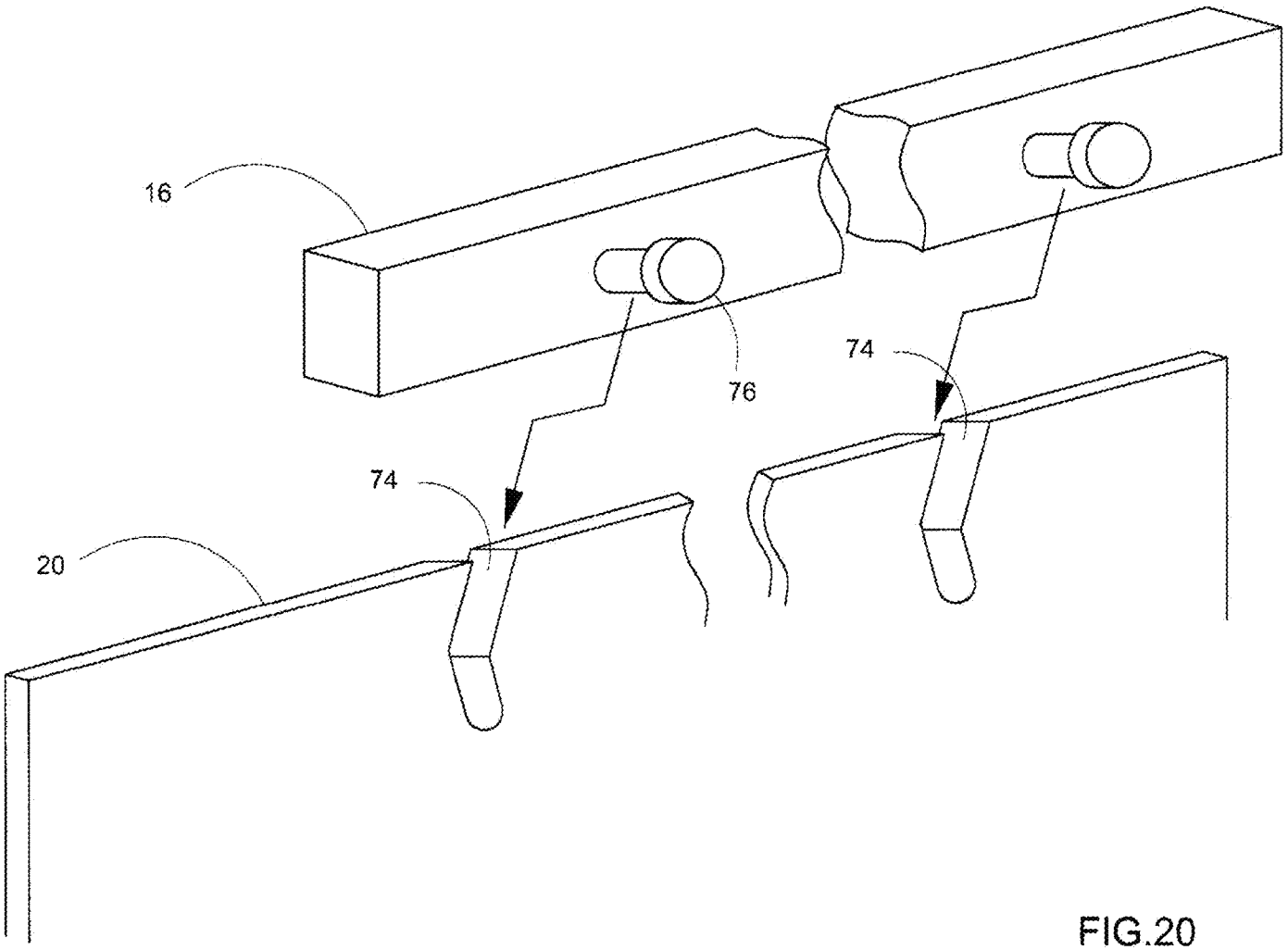
FIG. 20 is close up perspective view of the base frame assembly.

FIG. 20 shows a close up of one embodiment whereby the furniture frame is assembled by an interconnect of frame components with locking pin 76 of scissor mechanism 16 configured to insert into channel lock 74 of base frame 20.

Figure 21:
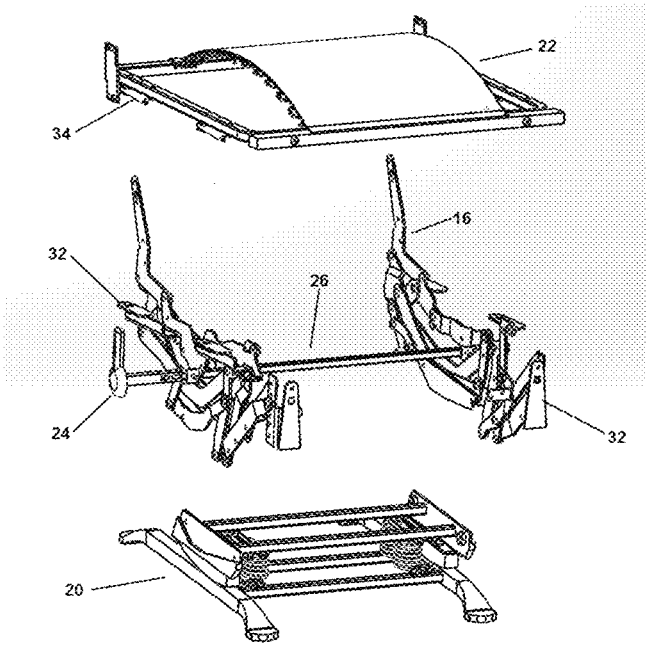
FIG. 21 is a separated perspective view of the base frame, scissor recliner mechanisms, and seat frame.
Figure 22:
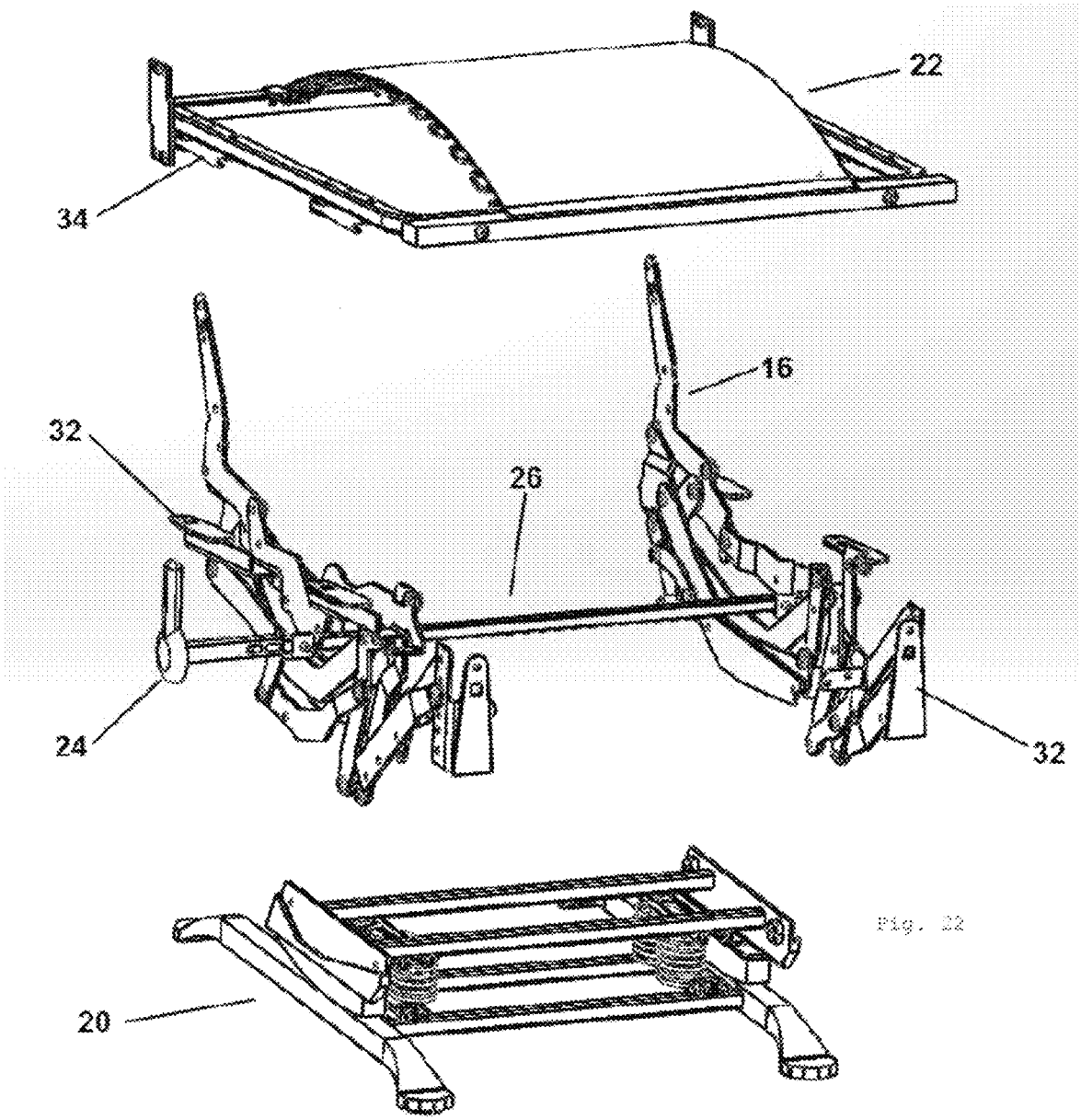
FIG. 22 is a separated perspective view of the base frame, scissor recliner mechanisms, and seat frame.

FIG. 21 demonstrates arrangement of parts whereby frame 20 receives the pair of scissor mechanisms 16 and scissor mechanisms 16 connect to seat frame base 22.

Figure 23:
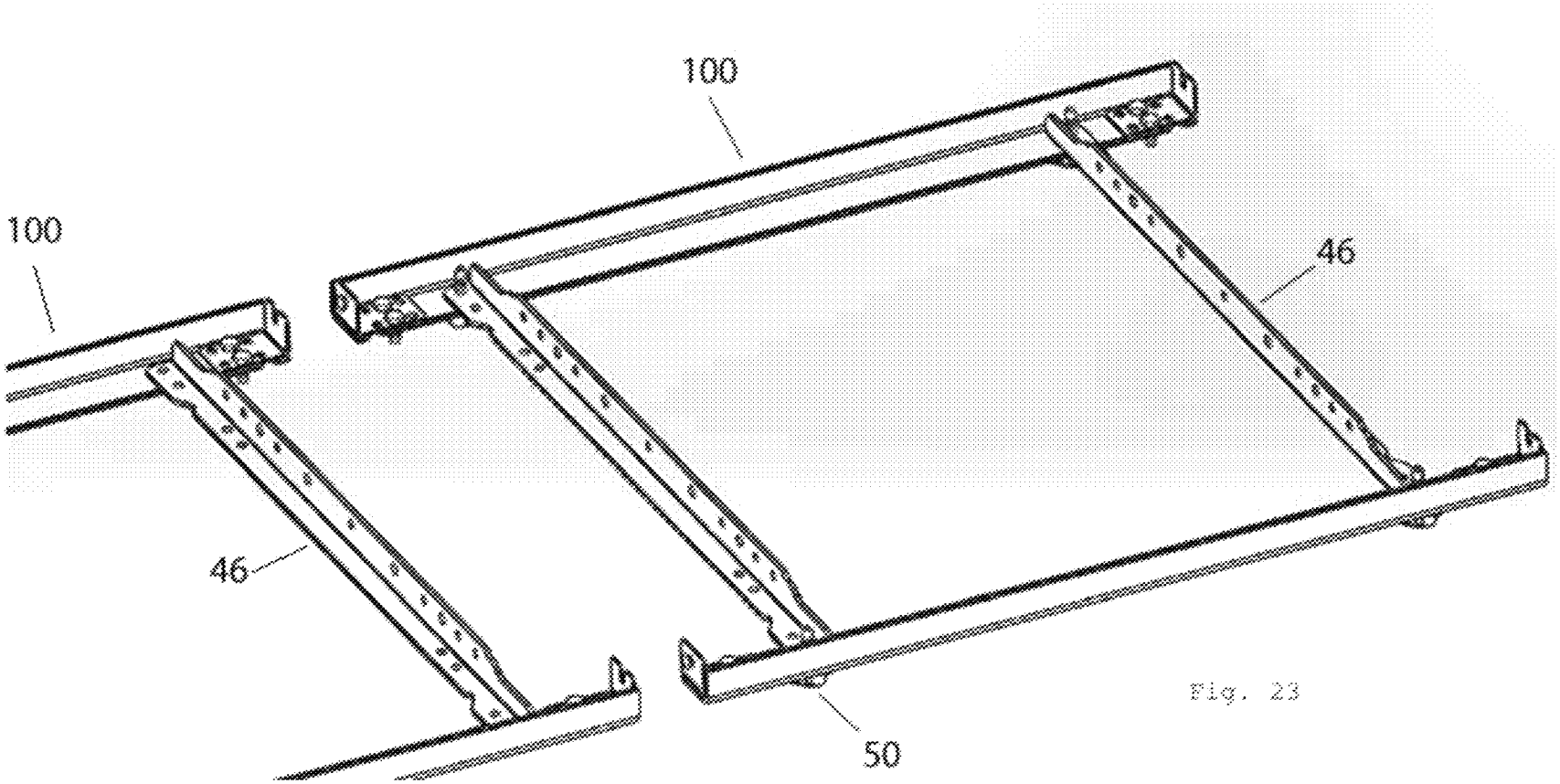
FIG. 23 is a perspective view of a pair of base frames prior to interconnection one to another to form the base of a larger article of furniture.

As demonstrated in FIG. 23, base rails 100 connect to base frame members 46. In one embodiment, base rails 100 are formed to connect as shown using suitable male-female connectors to attach and connect two or more frames in order to form a larger article of furniture.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A connection apparatus for furniture, comprising:

a pair of scissor mechanisms, one left facing and one right facing, each with a top, bottom, front and back;

a pair of first connectors, each first connector medially attached to the bottom of each of said scissor mechanisms; and a pair of second connectors, each second connector medially attached to the top of a furniture base on opposite sides of the base;

wherein each of said second connectors is adapted to receive and snap-lock connect with a corresponding first connector.

2. The connection apparatus of claim 1, wherein the furniture base consists of one of: a rocker base, a swivel base, a glider base, a glider-swivel base, a stationary base, or combinations thereof.

3. A connection apparatus for furniture, comprising:

a pair of scissor mechanisms, one left facing and one right facing, each with a top, bottom, front and back;

two pairs of seat connectors, each pair of seat connectors attached to the top of each of said scissor mechanisms, each seat connector comprising a first end and a second free end; and two pairs of seat box connectors, each pair of seat box connectors mounted on a furniture seat box on opposite sides of the furniture seat box, each seat box connector comprising a slot or opening adapted to receive and snap-lock connect with the second end of the corresponding seat connector.

4. The connection apparatus of claim 3, further comprising one or more arms connected to said furniture seat box by a plurality of male-female connectors.

5. A connection apparatus for furniture, comprising:

a pair of scissor mechanisms, one left facing and one right facing, each with a top, bottom, front and back;

a pair of footrest connection brackets, each footrest connection bracket comprising a first end and a second end, said first end securely attached to the front of a corresponding scissor mechanism, said second end extending away from the corresponding scissor mechanism; and a pair of footrest receiving brackets attached to a footrest, each footrest receiving bracket comprising a slot or opening adapted to receive the second end of the corresponding footrest connection bracket.

6. The connection apparatus of claim 5, wherein each scissor mechanism further comprises a seat back connection bracket attached to the back of each scissors mechanism, said seat back connection bracket adapted to attach to a corresponding bracket on a furniture seat back.

7. A connection apparatus for furniture, comprising:

a pair of scissor mechanisms, one left facing and one right facing;

at least one mounting receiver with a locking orifice, said at least one mounting receiver formed on a side of a corresponding scissor mechanism facing the other scissor mechanism; and a drive bar or tube with a right end and a left end extending between the pair of scissor mechanisms, at least one of said right end and left end comprising a spring-socket ball connect mechanism adapted to be inserted into a corresponding mounting receiver and snap-lock connected thereto by mating of the spring-socket ball with the locking orifice.

8. The connection apparatus of claim 7, wherein at least one of said right end and left end is connected to the corresponding scissor mechanism with male/female clips.

9. The connection apparatus of claim 7, further comprising a foot rest release handle mechanically linked to one end of said drive bar or tube.

10. A connection apparatus for furniture, comprising:

a pair of scissor mechanisms, one left facing and one right facing, each with a top, bottom, front and back;

a pair of spring clip receivers, each spring clip receiver mounted on a side of a corresponding scissor mechanism facing the other scissor mechanism; and a stabilizer or support bar or tube with a right end and a left end extending between the pair of scissor mechanisms, said right end and left end each comprising an insertion element with a locking orifice adapted to be inserted into a corresponding spring clip receiver and snap-lock connected thereto.

* * * * *